United States Patent [19]

Clement

[11] Patent Number: 5,072,211

[45] Date of Patent: Dec. 10, 1991

[54] SAFE ALARM SYSTEM

[76] Inventor: Roger B. Clement, 175 E. Center St., Spanish Fork, Utah 84660

[21] Appl. No.: 547,836

[22] Filed: Jul. 3, 1990

[51] Int. Cl.[5] ..... G08B 19/00

[52] U.S. Cl. ..... 340/521; 109/38; 109/21; 340/584; 340/566; 340/588; 340/596

[58] Field of Search ..... 340/521, 537, 539, 566, 340/573, 584, 588, 596, 683; 374/144, 158; 109/40, 41, 43, 48, 31, 21, 38, 23

[56] References Cited

U.S. PATENT DOCUMENTS

| | | | |
|---|---|---|---|
| 1,041,395 | 10/1912 | Williams | 109/40 |
| 3,851,602 | 12/1974 | Lamping | 109/23 |
| 4,168,626 | 9/1979 | Fullager | 374/158 |
| 4,752,770 | 6/1988 | St. Pierre | 340/596 |

FOREIGN PATENT DOCUMENTS

| | | | |
|---|---|---|---|
| 2538023 | 6/1984 | France | 109/40 |

*Primary Examiner*—Donnie L. Crosland
*Assistant Examiner*—Nader Sayegh
*Attorney, Agent, or Firm*—Trask, Britt & Rossa

[57] ABSTRACT

An alarm system to be used with safes is disclosed. A housing is provided adapted to be mounted to the exterior of a safe, particularly a personal home or business safe. A heat sensor is mounted to a shaft that extends from the housing into the safe. The shaft is designed to pass through a preexisting hole found on many commercial available safes. The heat sensor is electronically linked with a control system adapted to sound an alarm when more than a preselected temperature is sensed at the heat sensor. A motion sensor is also mounted in the housing to sense when more than a preselected amount of motion is sensed in the safe.

3 Claims, 3 Drawing Sheets

SAFE ALARM SYSTEM

BACKGROUND OF THE INVENTION

1. Field

The present invention is directed to an alarm system to be used with security safes.

2. State of the Art

Many individuals and businesses keep money and/or valuables in on-site personal security safes. In comparison to large-scale bank vaults, such safes are relatively small, lightweight, and inexpensive. These safes may be as small as a cubic foot or less in volume, for example, to be mounted in a wall. Or they may be several dozen cubic feet in volume and adapted to be free standing. They are typically formed having a shell of heavy gauge steel. A door is provided a locking mechanism, such as a combination lock, to allow access to the interior.

Large scale vault-type safes, such as those used in banks, are constructed with various security devices built in to alert the bank when an attempt is made to open the vault. For example, such vaults may include an electronic eye or other sensors to trigger an alarm when the vault door is opened. However, many personal safes, such as those purchased by businesses or individuals to store smaller quantities of items, are not so constructed. The security of such compact safes is typically dependent upon the structural integrity of the safe walls and the door during a break in attempt.

Such personal safes are not impervious to being broken into. Various methods have been devised for breaking open the door or cutting into the safe. Thieves may use a crowbar or other mechanical means of jamming the door open. Or they may use, for example, an acetylene cutting torch to cut a hole in the side of the safe or door. One method is to cut a hole big enough to gain access to the lock or opening mechanism of the door.

There remains a need for an alarm system adapted to be used with personal or compact safes to trigger an alarm upon attempts to break into the safe.

SUMMARY OF THE INVENTION

The present invention provides an alarm system for use with security safes. A housing is adapted to be mounted to a safe. A control circuit is associated with the housing. Heat sensing means is associatively linked with the control circuit. Alarm means is associatively linked with the control circuit for producing a sensory signal based upon input from the control circuit. The control circuit is adapted to activate the alarm means when the temperature in the interior of the safe exceeds a preselected value.

In a preferred embodiment, the heat sensing means extends from the housing through a hole formed in the safe into the interior of the safe. The alarm system may further comprise a motion sensor associatively linked with the control circuit to activate the alarm when more than a preselected amount of motion is sensed.

BRIEF DESCRIPTION OF THE DRAWINGS

In the drawings, which illustrate that which is regarded to be the best mode of the invention.

DETAILED DESCRIPTION OF THE ILLUSTRATED EMBODIMENT

Figure 1:
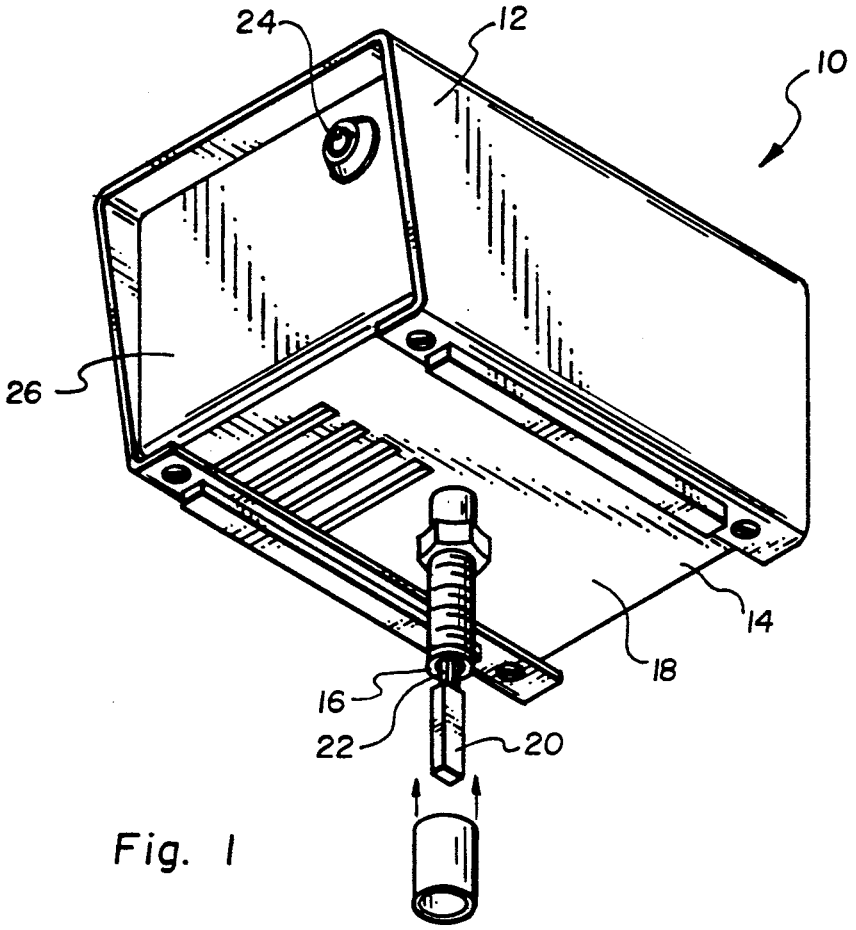
FIG. 1 is a bottom perspective view of a safe security system.

Referring to FIG. 1, the illustrated safe security system includes a housing generally indicated at 10 having an outer housing member 12 and an inner housing member 14. The illustrated housing 10 is formed to be a generally rectangular box and is preferably formed of a strong, rigid material such as heavy-gauge plate steel, aluminum, or impact and heat resistant plastic. Outer housing 12 also has padding on the bottom thereof to prevent damage to the painted surface of the safe when it is installed.

A threaded, cylindrically tubular shaft 16 extends from a lower face 18 of inner housing member 14. A heat sensor 20, described more completely below, and connected to wires 22, extends from the tubular shaft or extension 16 as shown. Shaft 16 is protected by a cylindrical sleeve which is attached to the shaft 16 after installation of alarm.

Figure 2:
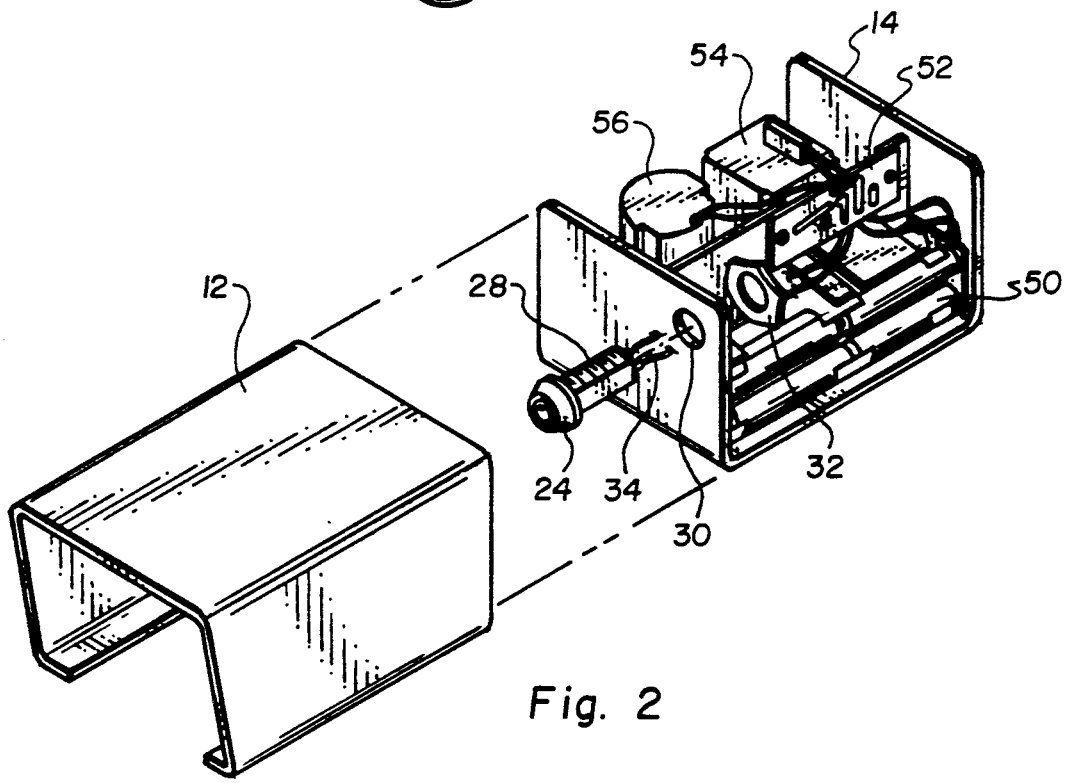
FIG. 2 is a partially exploded view of the safe security system of FIG. 1.

A key switch 24 is attached to a front face plate 26 of inner housing member 14. Referring to FIG. 2, key switch 24 has a cylindrical threaded shaft 28 that fits into a hole 30 formed in the face 26 of housing member 14. A nut 32 is then threaded onto shaft 28 to hold key switch 24 in place, as shown in FIG. 1. Key switch 24 is connected by wires 34 to the control circuit described below.

Figure 3:
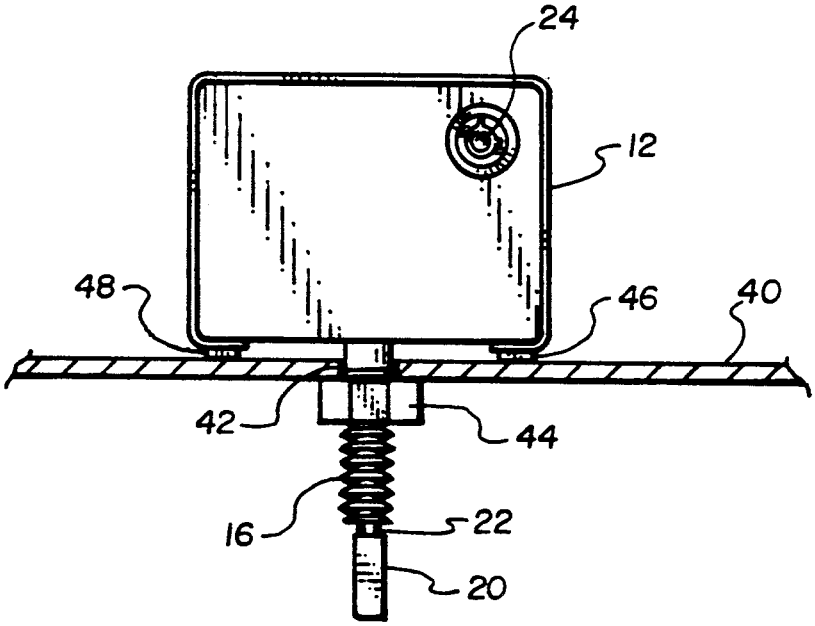
FIG. 3 is a side, partial sectional, view of the safe security system of FIG. 1 mounted to a safe.

Referring to FIG. 3, the alarm system of FIG. 1 is shown mounted to a portion of a wall 40 of a typical safe, such as a compact personal safe used in a home or business. The alarm system is attached to the safe by means of shaft 16 passing through a hole 42 formed in wall 40 and a threaded nut 44, which associates with the threads of shaft 16, which is tightened against wall 40, as shown. The alarm system has a pair of rubber-like feet 46 and 48 attached to housing member to provide a resilient cushion between member 12 and wall 40.

A hole such as hole 42 is typically already formed in many compact safes available commercially. This hole is used during the manufacture, and particularly during the painting process of the safe. During the painting process, the safe must be held up to allow the paint to be sprayed around the outer surface of the safe. Holes such as holes 42 allow a holding device to enter the interior of the safe so that the safe can be held up while spraying is completed. The illustrated safe alarm system is designed to make use of such a hole already in existence, so that the alarm system can be easily and conveniently mounted to the safe without the need for any modification to the safe. If a particular safe did not have such a hole, such a hole could be drilled to allow installation such as shown in FIG. 3.

Figure 4:
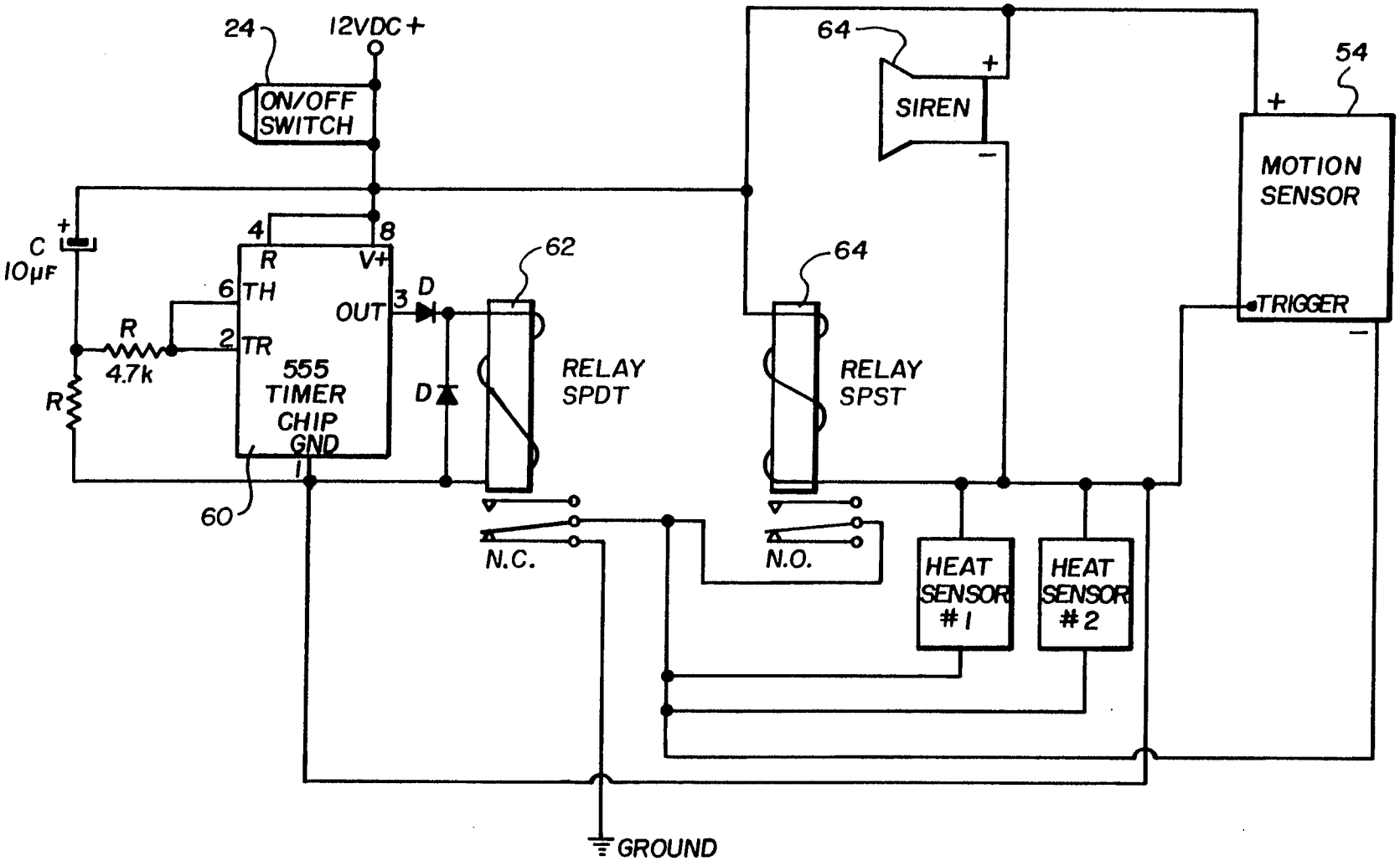
FIG. 4 is a schematic circuit diagram of a control system.

FIGS. 1 and 2 illustrate certain electrical components in general appearance, while FIG. 4 illustrates these components in the form of a schematic circuit diagram. These components include a set of batteries 50, providing 12 volt DC power, a circuit board 52, a motion sensor 54, and heat sensor 20.

Referring to FIG. 4, important components of this control system include a 555 timer chip 60 and relays 62 and 64. Relays 62 and 64 are single-pole, double throw relays that include 12 volt coils and are rated at 1 amp. Relay 62 contains a normally closed (N.C.) switch, and relay 64 contains a normally open (N.O.) switch. Both relays are shown in their normal positions.

Motion sensor 54 is linked as shown to relay 64. Motion sensor 54 has three lead wires, a positive and a negative power supply lead, and a trigger lead linked with relay 64, as shown. A usable motion sensor is available from Tandy Electronics, part no. 49-630. This motion sensor has an adjustment screw to allow for the selection of a preselected amount of motion upon which it triggers.

Also linked with relay 64 are a heat sensor number 1 and a heat sensor number 2, as shown. Usable heat sensors are available from Portage Electric Products, Inc., of North Canton, Ohio. These heat sensors are preset at the factory at a preselected temperature at which they will trigger. It has been found that a useful temperature setting for these sensors is 120° F.

The siren, motion sensor, and relay 64 are also connected to 12 volt D.C. at this point. Circuit board or electronic circuit is connected to a 12 volt DC positive power supply as shown, through on/off switch 24. Switch 24 is a key switch adapted to accept a key to open or close the circuit, to thereby deliver 12 volt D.C. power to the circuit board or elctronic circuit. The 12 volt DC power supply is provided by batteries 50 (FIG. 2). Therefore, unless switch 24 is turned on, no power is delivered to any portion of the control system or other electronic components.

The shown capacitors and resistors connected to the indicated pins of timer chip 60 provide for a preselected time value to be derived by timer chip 60 before a high voltage signal is emitted at pin 3 (OUT). A useful time period for this delay has been found to be about 3½ minutes.

Heat sensor number 1 and heat sensor number 2 and motion sensor 54 are connected as shown to relay 64, which contains a normally open switch. The heat sensors and the motion sensor are mechanical in nature and draw no current until they are activated by heat or motion. When the preselected amount of heat is sensed by heat sensor number 1 or number 2, or when a preselected amount of motion is sensed at motion sensor 54, a ground potential is provided by heat sensor number 1, heat sensor number 2, or motion sensor 54 to relay 64 to then close the normally open switch of relay 64.

When relay 64 goes to its closed position, ground potential is supplied through relay 64 and relay 62 to the negative lead of siren 64, so that siren 64 begins to sound. At the same time, a ground potential signal is also delivered to timer chip 60 to begin the timing sequence of chip 60.

After chip 60 waits its preselected time, about 3½ minutes, it outputs a high voltage signal (12 V) at pin 3. This signal momentarily opens the switch in relay 62 to break the ground to the rest of the circuit. As this happens, the switch in relay 64 goes back to its normally open position to turn off the siren. The switch in relay 62 flips back to its normally closed position, and the system is reset and ready to again sense motion or heat.

In use, for example, after a user has placed valuable articles or money in his safe, and closed the door to the safe, the user arms the system by placing a key in key switch 24 and turning the switch to turn the system on.

After the system is armed, if someone were to try to break into the safe, for example by jamming the door open with a crowbar or other lever, the motion involved in such activities would trigger motion sensor 54 to then sound siren 64 as described. If a thief were to use a cutting torch, such as an acetylene torch, the cutting activity may not cause sufficient motion to trigger the motion sensor 54. However, such cutting activities would trigger either heat sensor number 1 or heat sensor number 2. The illustrated embodiment of the alarm system provides a heat sensor at the end of shaft 16 to conveniently make use of holes that commonly exist in commercially available safes. Another heat sensor may be placed at various locations in the safe with lead wires running to the alarm system if additional security were desired. The rise in temperature due to cutting with a cutting torch would typically be sufficient to trigger either heat sensor number 1 or heat sensor number 2 and to thereby cause siren 64 to sound.

The siren will sound for 3½ minutes before it shuts off. This time period is believed to be sufficient to encourage the thief to leave the area or to attract the attention of the owner of the safe. If the thief continues to tamper with the safe, the alarm will continue to sound. This timing feature also saves battery life, since without it, the siren would continue to sound until the batteries wore out. In more economical versions of the alarm system, the timer circuit may be eliminated.

After siren 64 has sounded and the user has taken whatever action is needed, he may turn the system off, including the siren, by simply turning the on/off switch 24 to its off position, thus removing the 12 volt potential from the system. After whatever steps need to be taken, the user can re-arm the system by simply turning switch 24 back on.

Reference herein to details of the illustrated embodiment is not intended to limit the scope of the appended claims, which themselves recite those features regarded as important to the invention.

I claim:

1. An alarm device for use with a security safe, comprising:

a housing having a threaded extension mounted thereon, said threaded extension being formed to pass through a hole formed in said safe for mounting said housing to the exterior of said security safe;

a control circuit positioned within said housing;

a heat sensing device connected to said control circuit and mounted within said threaded extension, said heat sensing device extending from said housing through said hole formed in said security safe; and an alarm positioned within said housing and connected to said control circuit, said alarm being adapted to produce a sensory alarm signal based on input from said control circuit;

said control circuit being adapted to activate said alarm when the temperature at said heat sensing device is above a preselected value, wherein said housing is held in place on said safe by means of a threaded nut threadedly mounted on said threaded extension.

2. An alarm system according to claim 1 wherein said hole in said safe is formed during fabrication of said safe.

3. An alarm device according to claim 2 further comprising a motion sensing device connected to said control circuit, said control circuit being adapted to activate said alarm when more than a preselected amount of motion is sensed by said motion sensing device.

* * * * *